US008118954B2

(12) United States Patent
Beenken et al.

(10) Patent No.: US 8,118,954 B2
(45) Date of Patent: Feb. 21, 2012

(54) METHOD FOR PRODUCING A METALLIC COMPONENT COMPRISING ADJACENT SECTIONS HAVING DIFFERENT MATERIAL PROPERTIES BY MEANS OF PRESS HARDENING

(75) Inventors: Heiko Beenken, Soest (DE); Thomas Heller, Duisburg (DE); Franz-Josef Lenze, Lennestadt (DE); Sascha Sikora, Lünen (DE)

(73) Assignee: Thyssenkrupp Steel Europe AG, Duisburg (DE)

( * ) Notice: Subject to any disclaimer, the term of this patent is extended or adjusted under 35 U.S.C. 154(b) by 670 days.

(21) Appl. No.: 11/916,215

(22) PCT Filed: May 24, 2006

(86) PCT No.: PCT/EP2006/062579

§ 371 (c)(1),
(2), (4) Date: Mar. 28, 2008

(87) PCT Pub. No.: WO2006/128821

PCT Pub. Date: Dec. 7, 2006

(65) Prior Publication Data

US 2008/0196800 A1 Aug. 21, 2008

(30) Foreign Application Priority Data

May 30, 2005 (DE) ..... 10 2005 025 026

(51) Int. Cl.

| | |
|---|---|
| ***C22F 1/16*** | (2006.01) |
| ***C21D 8/00*** | (2006.01) |
| ***C21D 6/00*** | (2006.01) |
| ***B21D 37/16*** | (2006.01) |

(52) U.S. Cl. ..... 148/714; 148/639; 148/643; 72/342.3; 72/342.7; 72/342.94

(58) Field of Classification Search ..... 148/639, 148/643, 714; 72/342.7, 342.94, 342.3
See application file for complete search history.

(56) References Cited

U.S. PATENT DOCUMENTS

| | | | | |
|---|---|---|---|---|
| 3,703,093 | A * | 11/1972 | Komatsu et al. | 72/342.4 |
| 2002/0113041 | A1 * | 8/2002 | Ozawa | 219/50 |

FOREIGN PATENT DOCUMENTS

| | | | |
|---|---|---|---|
| DE | 2 452 486 | A1 | 5/1975 |
| DE | 19 723 655 | A1 | 12/1997 |
| DE | 10 049 660 | A1 | 4/2002 |
| DE | 10 341 867 | | 3/2005 |
| EP | 1 666 170 | | 6/2006 |
| WO | WO 2005/021178 | | 3/2005 |

* cited by examiner

OTHER PUBLICATIONS

International Search Report for PCT/EP2006/062579, Aug. 2006.

*Primary Examiner* — Roy King
*Assistant Examiner* — Caitlin Kiechle
(74) *Attorney, Agent, or Firm* — Proskauer Rose LLP

(57) ABSTRACT

A method for producing a metallic component (B) allows adjoining zones (Z1, Z2, Z3) having differing material properties to be produced in a manner which is simple in terms of production. This is achieved in that a sheet metal element (E) heated to a forming temperature is shaped in a forming tool (1) into an end-shaped component (B), wherein the forming tool (1) has a temperature adjustment means for adjusting the temperature of at least one of the portions (5, 7, 16) thereof that comes into contact with the sheet metal element (E) during the forming process, and in that the forming speed is controlled in consideration of the time for which the portion (5, 7, 16) of the forming tool (1) that is regulated with regard to the temperature thereof is in contact with the respective region (E1, E2, E3) of the sheet metal element (E) that rests against said portion.

11 Claims, 3 Drawing Sheets

METHOD FOR PRODUCING A METALLIC COMPONENT COMPRISING ADJACENT SECTIONS HAVING DIFFERENT MATERIAL PROPERTIES BY MEANS OF PRESS HARDENING

CROSS-REFERENCE TO RELATED APPLICATIONS

This application is a National Phase Application of International Application No. PCT/EP2006/062579, filed May 6, 2006, which claims the benefit of and priority to German Application No. 10 2005 025 026.2, filed May 30, 2005, which is owned by the assignee of the instant application. The disclosure of each of the above applications is incorporated herein by reference in its entirety.

FIELD OF THE INVENTION

The invention relates to a method for producing a metallic component comprising adjoining portions having differing material properties.

BACKGROUND OF THE INVENTION

In practice, methods of this type are used to produce by press hardening, for example from manganese-boron steels, components having a uniform hardening profile of up to 1,500 MPa. Owing to the low ductility remaining in such steels after the hardening process, components made of steels of this type are for this purpose conventionally first preformed, then heated to austenitising temperature and subsequently cooled rapidly in a mould under elevated pressure. In addition to their high hardness, parts obtained in this way display good dimensional stability.

A press hardening method forming part of the above-mentioned prior art is known, for example, from DE 103 41 867 A1. According to this method, a hardened sheet metal profile can be produced in that an intermediate form is first shaped from a sheet metal blank, this sheet metal profile is then heated to hardening temperature and in that finally the heated sheet metal profile is purposefully cooled in a device resembling a deep-drawing tool under the action of a predetermined pressing means. The intermediate form produced in the first step of the method thus approximately corresponds to the final form of the component to be produced.

The device used for carrying out the known method has channel-like cooling assemblies which, depending on the respective heat to be removed, are flushed with oil, water, ice water or saline solution. The cooling assemblies can be controlled separately of one another in order to form in the finished component zones having differing degrees of hardness.

Despite the advantages achieved in this way with the method known, for example, from DE 103 41 867 A1, there is demand for a method which can be carried out in a simplified manner in terms of production and allows components which are shaped from a sheet metal element and have precisely predeterminable zones having differing material properties to be produced.

SUMMARY OF THE INVENTION

In order to meet this demand, the invention features a method for producing a metallic component comprising adjoining portions having differing material properties, in which a sheet metal element heated to a forming temperature is shaped in a forming tool into an end-shaped component, wherein the forming tool has a temperature adjustment means for adjusting the temperature of at least one of the portions thereof that comes into contact with the sheet metal element during the forming process, and in which the forming speed is controlled in consideration of the time for which the portion of the forming tool that is regulated with regard to the temperature thereof is in contact with the respective region of the sheet metal element that rests against said portion.

According to the invention, in addition to the measures known from DE 103 41 867 A1 for producing a finished component comprising zones having differing material properties, such as strength or deformability, the speed at which the respectively machined sheet metal element is shaped into its final form is adjusted in such a way that the temperature-adjusted regions of the tool, the temperature of which differs from the adjacent portions, come into contact with the zones of the sheet metal element that are to be treated separately within an optimum period of time for the desired working result and that this contact is maintained, in view of the other general forming conditions, over a likewise optimum period of time. In this way, the method according to the invention can be used to produce within a minimized processing time a sheet metal component which has precisely determined zones having material properties which differ from those of its other portions.

If, according to the invention, there is to be produced in the finished component a zone having higher hardness than the surrounding zones, the sheet metal element may for this purpose, according to the invention, first be heated to a forming temperature, starting from which a hardened structure forms during accordingly rapid cooling. In this case, the temperature adjustment means is configured as a cooling means which cools the portion of the forming tool that is respectively associated therewith to a sufficiently low temperature that the respective zone of the sheet metal element is quenched, on contact with this cooled portion, at a speed sufficient for the production of the desired hardened structure.

Conversely, however, it is also possible to form in the finished component zones which have lower hardness than the zones surrounding them. For this purpose, the temperature adjustment means which is provided in accordance with the invention can be configured as a heater which keeps the portion of the tool that is associated with the less hard zone of the finished sheet metal component at a sufficiently high temperature that a relatively soft structure is maintained on contact of the sheet metal with this portion.

If a plurality of temperature adjustment means are present, purposefully cooled and heated portions of the tool can be arranged closely adjacent to one another with the aim of reducing to a minimum in the finished sheet metal part the spread of regions comprising undefined mixed structures at the point of transition between a zone having high hardness and the adjacent zones surrounding it and thus of producing in the finished component zones which are defined with optimum precision and have differing material properties.

The linking, provided in accordance with the invention, of the forming speed to the position and spread of the zones which are to be produced in the finished component and have differing material properties is particularly important in this connection. Thus, for producing a particularly hard zone in the finished component, the forming speed can, according to the invention, be selected in such a way that the respective zone enters into contact with the markedly cooled portion of the tool as rapidly as possible. Conversely, the forming speed is reduced if, for example, a specific zone of the component is to be cooled particularly slowly in order to produce a softer structure at this location.

The purposeful shaping of specific zones having particular material properties in the finished sheet metal component can additionally be assisted in that that a holding-down force regulated as a function of the forming speed is exerted on an edge region of the sheet metal element during shaping.

Suitable, in principle, for application of the method according to the invention are all sheet metal elements which are made of metallic materials and the structure of which changes on heating or cooling. However, the method according to the invention can be applied particularly advantageously for sheet metal elements consisting of steel. Specifically in the case of sheet metal elements made of steel material, the advantages of the invention can be utilized in a particularly targeted manner.

An embodiment of the invention that is particularly beneficial from the point of view of production is characterized in that the sheet metal element used as a starting product in the method according to the invention is a flat sheet metal blank. In this variation of the method according to the invention, in contrast to the prior art, an as yet non-deformed, flat sheet metal part is brought to the respective forming temperature, starting from which the locally differing material properties of the metal sheet that are to be produced during the subsequent shaping process can be achieved. Subsequently, shaping of the heated sheet metal element, for example in the manner of a deep-drawing process, is completed in the forming tool. At the same time, there is carried out in the forming tool the purposeful, locally delimited cooling or heating treatment of those zones of the sheet metal element in which the particular properties are to be produced. As a result, there is thus obtained, without at least one complete operation which is invariably required in the prior art discussed at the outset, namely the pre-shaping, a component which is finished from a metal sheet and has precisely determined, locally delimited regions having particular material properties which differ from those of the adjoining regions of the finished component, such as higher hardness.

A further advantage of the procedure according to the invention is that it is particularly suitable for the processing of sheet metal elements having regions of differing thickness. Specifically in the case of shaping of sheet metal elements of this type, the invention allows the formation of the desired, locally delimited zones having specific material properties allowing the forming speed and the respective temperature adjustment of the tool to be adapted to the non-uniform thickness of the sheet metal element so as to provide an optimum working result. This is particularly advantageous if the sheet metal element is composed of different sheet metal pieces which are interconnected with a material fit, in particular by welding. Sheet metal elements of this type are usually referred to as tailored blanks. They are composed, for example, of sheet metal pieces, the thickness or material property of which, such as hardness and toughness, are adapted to the loads to which the product produced from the tailored blank is exposed in practical use.

The forming tool can be any type of tool which is suitable, in view of the respective shaping of the component to be produced, for exerting the required shaping and pressing forces on the respectively deformed sheet metal element. Suitable for this purpose are, in particular, forming tools of the type having a female mould and a male mould which can be placed into the female mould for the purposes of shaping.

The method according to the invention is suitable, in particular, for the production of bodywork components which are exposed to varying loads in practical use. There can thus particularly effectively be produced, in the manner according to the invention, suspension strut receptacles requiring, for example, high strength in the region of the suspension strut top mounting, whereas relatively high ductility is required in the region of the flanks of the receptacles. The invention allows a purely martensitic, particularly strong structure purposefully to be produced in the region of the suspension strut top mounting in that this region is cooled rapidly and at a high cooling speed during the shaping according to the invention. The time-delayed contact of the tool with the other parts of the suspension strut receptacles allows there also purposefully to be produced at this location a bainitic, perlitic, ferritic or a mixed structure optimally satisfying the demands placed on the respectively required ductility or strength.

A further particularly advantageous application of the method according to the invention is the production of crash-relevant vehicle components which, in the event of a collision, have to have both a high energy absorption capacity and optimum strength. In this case, the invention allows the formation, by purposeful heating of the forming tool in specific portions in the finished component, of zones in which particularly high residual elongation is ensured.

BRIEF DESCRIPTION OF THE DRAWINGS

The invention will be described hereinafter in greater detail with reference to drawings which illustrate an embodiment and in which respectively.

DESCRIPTION OF THE INVENTION

The forming tool 1 is configured in the manner of a deep-drawing device and has a stationary female mould 2. Formed in the female mould 2 is a recess 3 which maps the outer shape of the component B which is to be produced and forms a profile.

Figure 1:
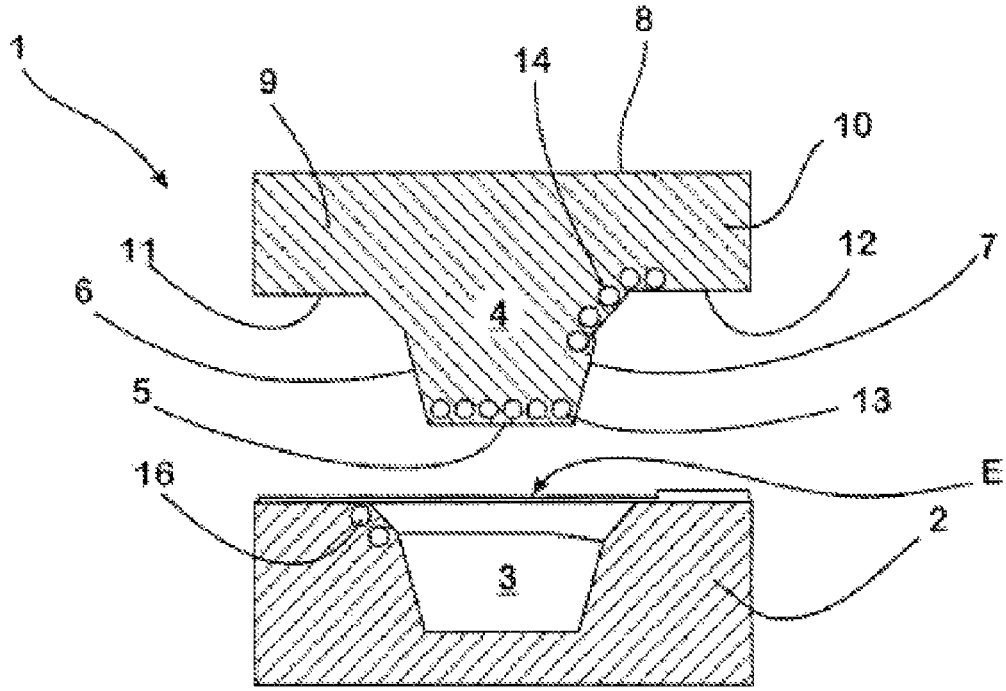
FIG. 1 is a schematic side view of a forming tool in a first operating position.
Figure 2:
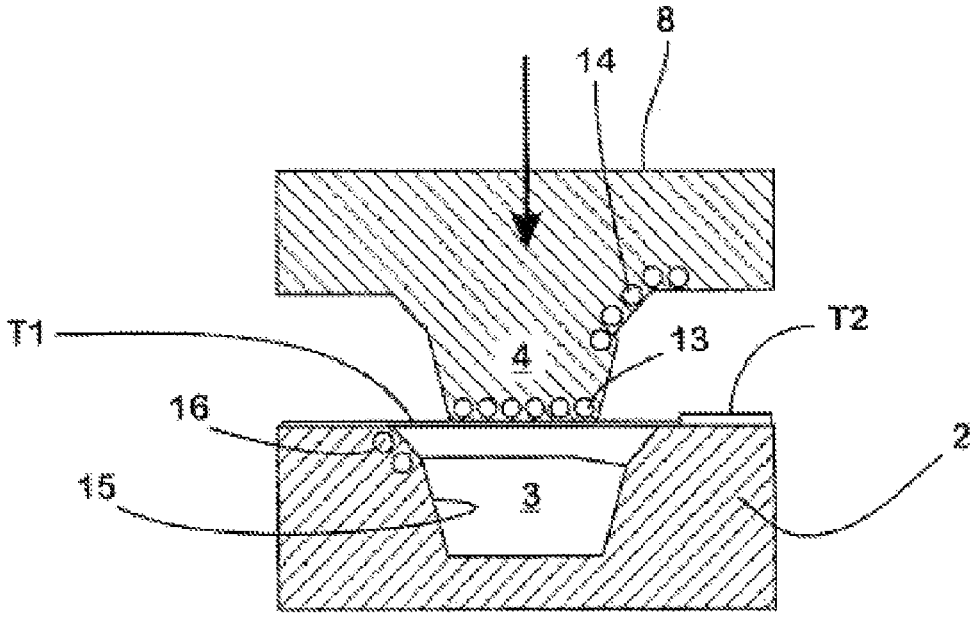
FIG. 2 is a schematic side view of the forming tool in a second operating position.
Figure 3:
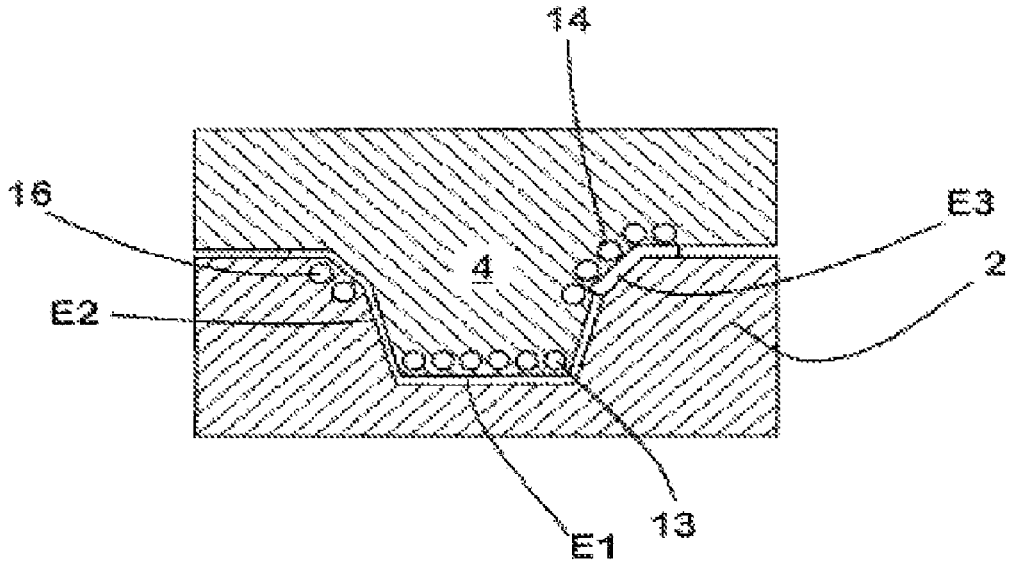
FIG. 3 is a schematic side view of the forming tool in a third operating position.
Figure 4:
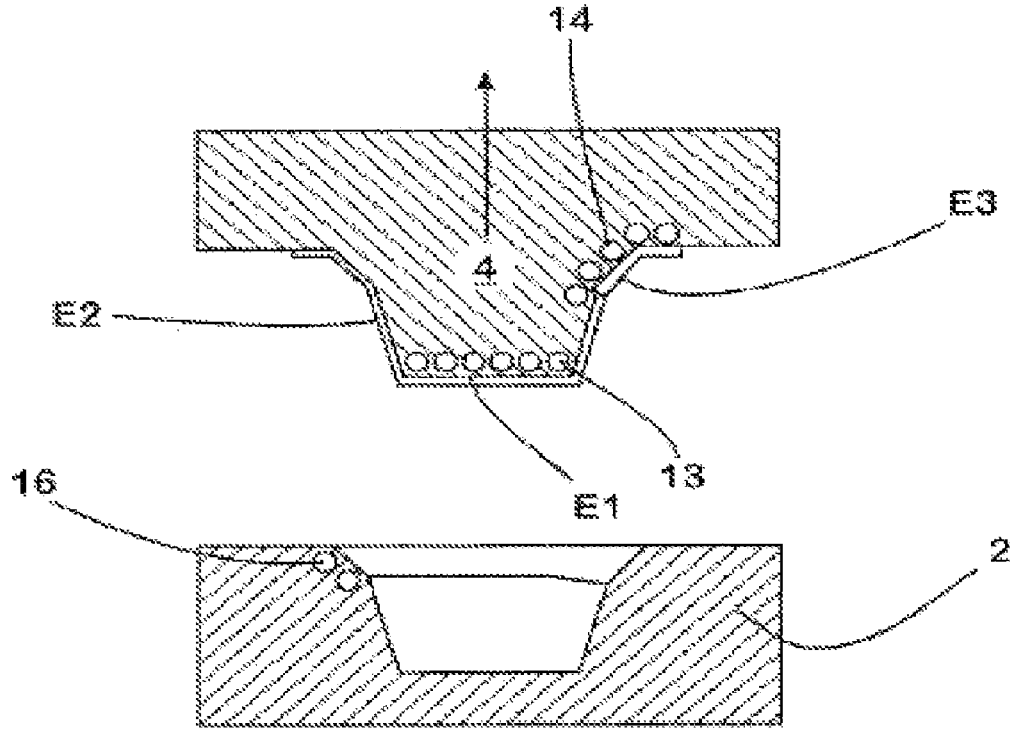
FIG. 4 is a schematic side view of the forming tool in a fourth operating position.
Figure 5:
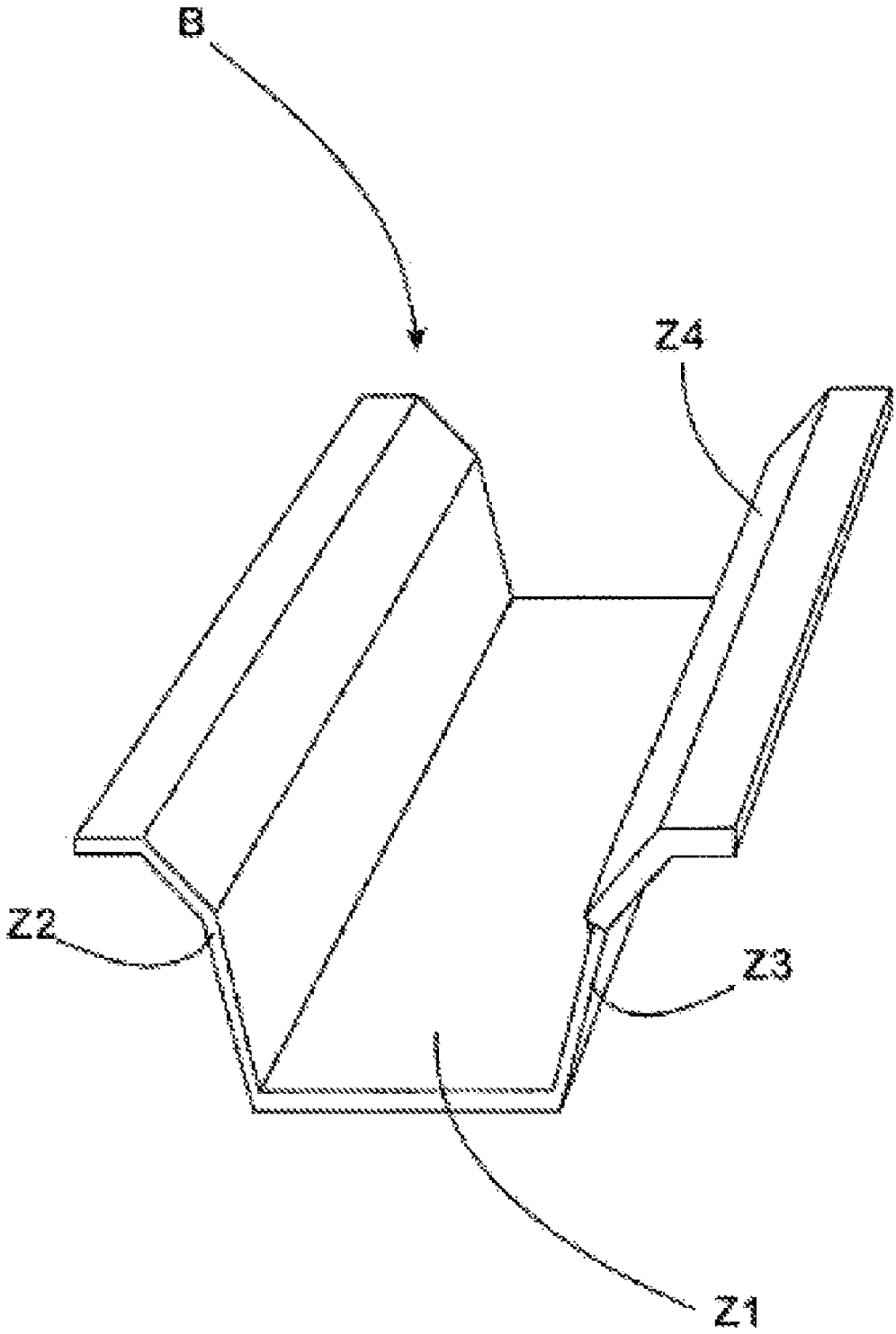
FIG. 5 shows schematically a component produced in the forming tool.

Additionally, the shaping tool 1 comprises a male mould 4 which determines the inner shape of the component B to be produced. The male mould 4 can be moved using an adjustment means (not shown) from a starting position remote from the female mould 2 (FIG. 1) into its end position in which it is fully introduced into the recess 3 in the female mould 2 (FIG. 3). The adjustment means comprises in this case a control means controlling the speed at which the male mould 4 enters the recess 3 in the female mould 2.

The male mould 4 has a basic shape which is trapezoidal in cross section with an end face 5 and lateral faces 6, 7 running obliquely toward the end face 5. The male mould 4 is carried by a carrier 8 which is integrally connected thereto and the lateral edge regions 9, 10 of which protrude in the manner of a collar laterally beyond the lateral faces 6, 7 of the male mould 4 at the upper edge thereof. The lower edge faces 11, 12 of the edge regions 9, 10 are in this case connected to the lateral faces 6, 7 of the male mould 4 in horizontal orientation.

In the embodiment described in the present case, there are processed in the forming tool 1 flat, non-preformed sheet metal elements E which are composed in the manner of tailored blanks from two sheet metal parts T1, T2 which are welded to each other and consist of a steel material. To save weight, the first sheet metal part 1 is in this case thinner in its configuration than the second sheet metal part T2.

Cooling channels 13 are formed in the male mould 4 in the region of its end face 5 which first enters into contact with the sheet metal element E during introduction into the recess 3 in the female mould 2. The cooling channels 13 are part of a first temperature adjustment means which is configured as a cooling means and is not illustrated in greater detail. Depending on the respectively required degree of cooling, there flows through the cooling channels 13 water, ice water, a saline solution cooled to a low temperature, liquid nitrogen or another cooling medium suitable for the rapid removal of large quantities of heat.

In the transition region which is associated with the thicker sheet metal part T2 of the sheet metal element E and at which the one lateral face 7 of the male mould 4 merges with the adjoining lower edge face 12 of the carrier 8, heating coils 14 of a second temperature adjustment means which is configured as a heating means and is also not illustrated in greater detail are located in the male mould 4.

Channels 16 of a third temperature adjustment means which is also not illustrated in greater detail in the present document are also positioned in the female mould 2 in the region of the lateral face 15 of the recess 3 which is associated with the lateral face 6 of the male mould 4. Conveyed through the channels 16 of the temperature adjustment means is a cooling oil causing moderate cooling of the female mould in this region.

For producing the component B, the sheet metal element E is first heated to austenitising temperature in a furnace (not shown in the present document). Subsequently, the sheet metal element E is placed in the forming tool 1, so its edge rests on the upper side of the female mould 2. Holding-down means (not shown), which hold the sheet metal element E down in its edge region during the subsequent shaping, are then attached if necessary for the further deformation of the sheet metal element E carried out in the forming tool 1. The holding-down force exerted by the holding-down means can in this case be adjusted as a function of the respective forming speed to allow optimised continued flowing of the material of the sheet metal element 4 into the recess 3.

Subsequently, the male mould 4 is attached to the sheet metal element E at high speed, so the markedly cooled end face 5 of the male mould 4 enters into intensive contact with the face portion E1 associated therewith of the sheet metal element E. The sheet metal element E is in this way quenched in its portion E1 sufficiently rapidly to form at this location a zone having hardness which is higher than the hardness of the other portions E2 and E3, adjoining the portion E1, of the sheet metal element E.

Subsequently, the advancement of the male mould 4 is reduced in order, in particular, not to cause in the portions E2 and E3 any cooling which might lead to the formation of a hard structure. In the region of the heating coils 14, in particular, only a reduced quantity of heat is removed via the male mould 4, so a softer, tougher structure is maintained in the regions of the sheet metal element E which enters into contact with this region of the male mould 4. In the regions cooled via the lateral faces which are cooled only moderately by way of the cooling oil flowing through the channels 16, there forms during the deformation in the portion E2 of the sheet metal element E a zone in which the hardened portion E1 gradually merges with a softer, more resilient zone of the finished component B.

Once the male mould 4 has fully entered the receptacle 3 of the female mould 2 and has fully compressed the sheet metal element 4 at this location, so the sheet metal element has assumed the final form of the component B to be produced, the male mould 4 returns to its starting position. Owing to the fact that the sheet metal element E has contracted following cooling, the finished component B is in this case still held on the male mould 4, so it can easily be removed from the female mould 2 and subsequently separated from the male mould 4.

The component B produced in this way by shaping of the sheet metal element E has a first zone Z1 having hardness which is higher than the hardness of the adjoining zones Z2 and Z3 of the component B. A zone Z4 having much lower hardness but higher ductility adjoins the zone Z3. This zone Z4 corresponds to the region of the sheet metal element E that was cooled only slightly during the shaping in the region of the heating coils 14. The zone Z2 corresponds to the region of the sheet metal element E that was cooled only moderately during the shaping in the region of the lateral face 15 of the female mould 2 and has accordingly moderate hardness.

REFERENCE NUMERALS

1 Forming tool
2 Female mould
3 Recess
4 Male mould
5 End face of the male mould 4
6, 7 Lateral faces of the male mould 4
8 Carrier
9, 10 Lateral edge regions of the carrier 8
11, 12 Lower edge faces of the edge regions 9, 10
13 Cooling channels
14 Heating coils
15 Lateral face of the recess 3
16 Channels
B Component
E Sheet metal element
E, E2, E3 Portions of the sheet metal element E
T1, T2 Sheet metal parts of the sheet metal element E
Z1, Z2, Z3, Z4 Zones of the component B

The invention claimed is:

1. A method for producing a metallic component comprising adjoining zones having differing material properties, in which a sheet metal element heated to a forming temperature is shaped in a forming tool into an end-shaped component, wherein the forming tool has a temperature adjustment means for adjusting the temperature of at least one portion thereof that comes into contact with the sheet metal element during the forming process, and in order to produce a finished component having differing material properties, the forming speed is varied and controlled during the shaping process in consideration of the time for which the portion of the forming tool that is regulated with regard to the temperature thereof is in contact with the respective region of the sheet metal element that rests against the portion.

2. The method of claim 1 wherein the sheet metal element comprises steel.

3. The method of claim 1 wherein the sheet metal element comprises a flat sheet metal blank.

4. The method of claim 1 wherein the sheet metal element has regions of differing thickness.

5. The method of claim 1 wherein the sheet metal element comprises different sheet metal parts which are interconnected with a material fit.

6. The method of claim 1 wherein the forming temperature corresponds to a hardening temperature, starting from which a hardened structure forms during cooling in the sheet metal element.

7. The method of claim 1 wherein the forming tool has a female mould and a male mould which can be positioned in a recess in the female mould for the purposes of shaping.

8. The method of claim 1 wherein the temperature adjustment means is a cooling means.

9. The method of claim 1 wherein the temperature adjustment means is a heater.

10. The method of claim 1 wherein a cooling means, as a first temperature adjustment means, is associated with at least one portion of the forming tool and a heater, as a second temperature adjustment means, is associated with at least one other portion of the shaping tool.

11. The method of claim 1 wherein a holding-down force regulated as a function of the forming speed is exerted on an edge region of the sheet metal element during shaping.

* * * * *